United States Patent [19]

Gottschald et al.

[11] Patent Number: 4,766,699

[45] Date of Patent: Aug. 30, 1988

[54] APPARATUS FOR GRINDING THE EDGES OF LENSES

[75] Inventors: Lutz Gottschald, Meerbusch; Fritz Kötting, Dormagen; Günther Barwasser, Neuss, all of Fed. Rep. of Germany

[73] Assignee: Wernicke & Co GmbH, Düsseldorf, Fed. Rep. of Germany

[21] Appl. No.: 25,486

[22] Filed: Mar. 13, 1987

[30] Foreign Application Priority Data

Mar. 18, 1986 [DE] Fed. Rep. of Germany ..... 3608957

[51] Int. Cl.[4] ..... B24B 7/00

[52] U.S. Cl. ..... 51/101 LG; 51/106 LG; 51/268; 51/269

[58] Field of Search ..... 51/101 LG, 105 LG, 101 R, 51/124 L, 266, 268, 284 R, 284 E, 105 EL, 106 LG, 271

[56] References Cited

U.S. PATENT DOCUMENTS

| | | | |
|---|---|---|---|
| 3,798,844 | 3/1974 | Hannaman | 51/101 LG |
| 4,561,213 | 12/1985 | Tusinski et al. | 51/106 LG |
| 4,589,231 | 5/1986 | Roberts | 51/124 L |

*Primary Examiner*—Robert P. Olszewski
*Assistant Examiner*—Maurina Rachuba
*Attorney, Agent, or Firm*—Becker & Becker, Inc.

[57] ABSTRACT

An apparatus for grinding the edges of lenses. A lens shaft is mounted on a frame, and a motor driven grinding wheel is provided that can be moved against a lens as well as parallel to the lens shaft. A chamber is mounted on the frame and accommodates a lens and the grinding wheel. A chamber has an observation window and walls, including oppositely disposed side walls that extend essentially perpendicular to the lens shaft, with these walls enclosing, and being spaced slightly from, the grinding wheel and the lens. The chamber has a width, i.e. the distance between the side walls, that is approximately equal to the thickness of the grinding wheel plus the axial displacement stroke of the latter. A wheel shaft that extends through one of the side walls of a chamber has two ends, one of which is disposed in the chamber and carries the grinding wheel, while the other end extends beyond the one side wall. A mechanism is provided that supports and drivingly interconnects the wheel shaft to a motor, with this mechanism being displaceably mounted on the frame in such a way that the mechanism and the wheel shaft, and hence the grinding wheel, can be moved toward and away from the lens, and parallel to the lens shaft, in two planes or directions that are essentially perpendicular to one another.

11 Claims, 1 Drawing Sheet

Fig.1
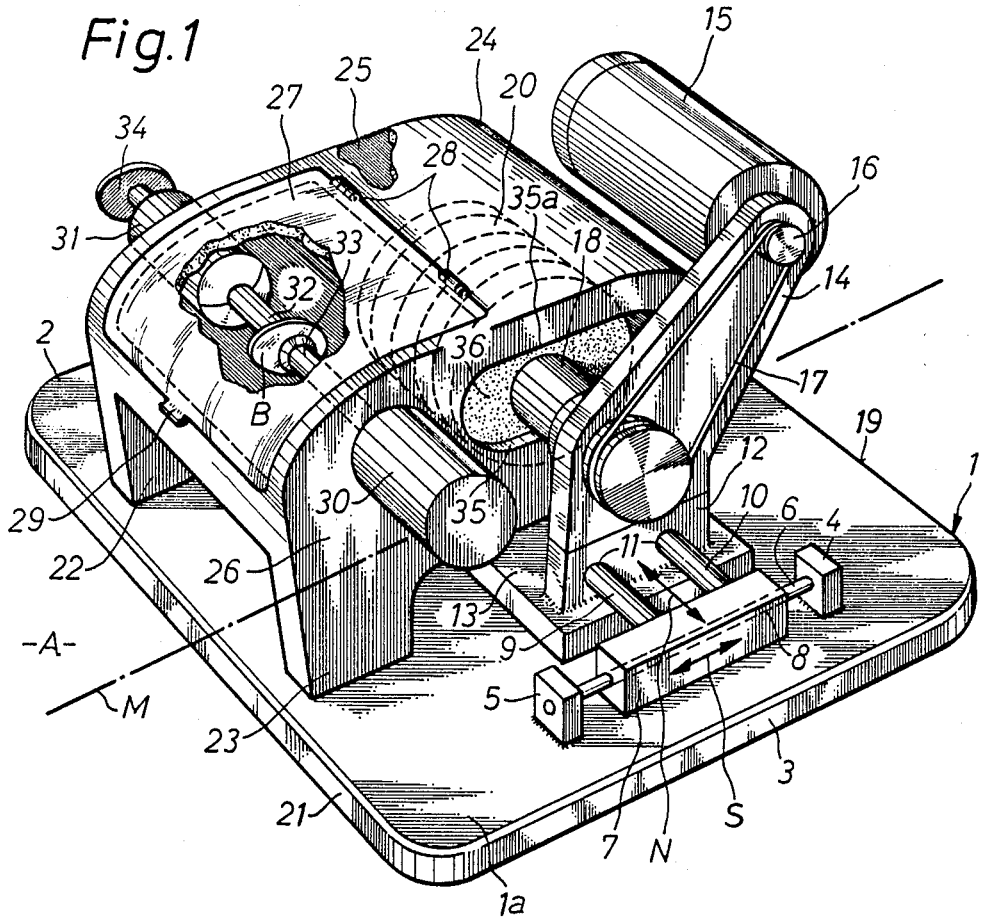
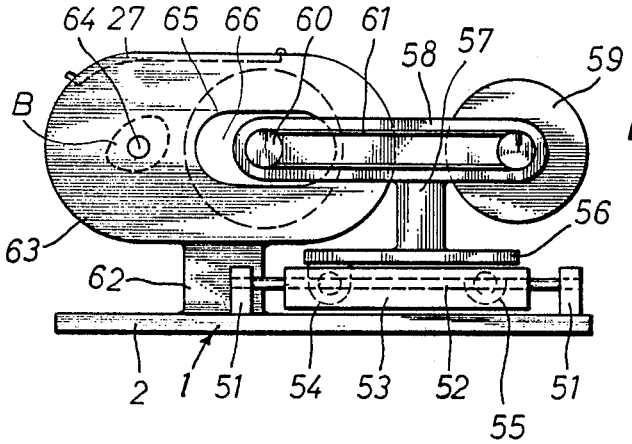
Fig. 2
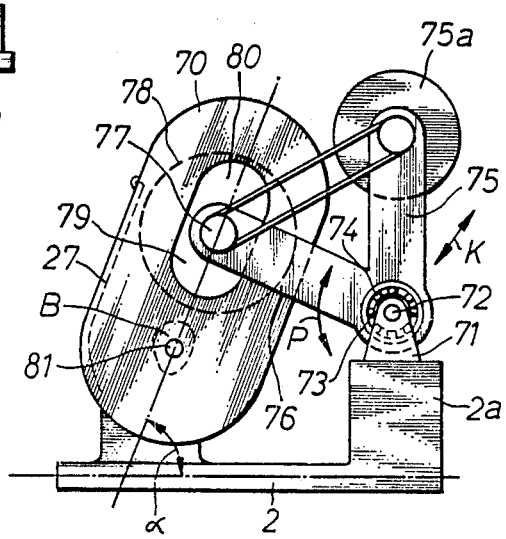
Fig.3

APPARATUS FOR GRINDING THE EDGES OF LENSES

BACKGROUND OF THE INVENTION

1. Field of the Invention

The present invention relates to an apparatus for grinding the edges of lenses.

2. Description of the Prior Art

German Offenlegungsschrift No. 34 46 943 Bouffechoux dated July 11, 1985 discloses a grinding apparatus. The task of this apparatus is to make it possible for the operator to be able to directly control the progress of the grinding process. The grind liquid is particularly thrown against the top of the chamber.

It is an object of the present invention to avoid the drawbacks of the known apparatus, to increase the sealing of the chamber, and to reduce the development of noise, without adversely affecting or obstructing the movement of the components.

BRIEF DESCRIPTION OF THE DRAWING

This object, and other objects and advantages of the present invention, will appear more clearly from the following specification in conjunction with the accompanying schematic drawing, in which:

FIG. 1 is a perspective and partially broken-away view of one exemplary embodiment of the inventive apparatus;

FIG. 2 is a side view of a second exemplary embodiment of the inventive apparatus; and FIG. 3 is a side view of a further exemplary embodiment of the inventive apparatus.

SUMMARY OF THE INVENTION

The inventive apparatus has: a frame; a lens shaft mounted on the frame; a motor driven grinding wheel that can be moved against a lens as well as parallel to the lens shaft; a chamber that is mounted on the frame and accommodates a lens and the grinding wheel, with this chamber having an observation window and walls, including oppositely disposed side walls that extend essentially perpendicular to the lens shaft, with said walls enclosing, and being spaced slightly from, the lens shaft and the lens, said chamber furthermore having a width, i.e. the distance between the side walls, that is approximately equal to the thickness of the grinding wheel plus the axial displacement stroke thereof, i.e. the displacement stroke of the grinding wheel parallel to the lens shaft; a wheel shaft that extends through one of the side walls and has two ends, one of which is disposed in the chamber and carries the grinding wheel, while the other end extends beyond said one side wall; and a mechanism that supports and drivingly interconnects the wheel shaft to a motor, with this mechanism being displaceably mounted on the frame in such a way that the mechanism and the wheel shaft, and hence the grinding wheel, can be moved toward and away from the lens, and parallel to the lens shaft, in two planes or directions that are essentially perpendicular to one another. The chamber is disposed either horizontally or at an angle, and the mechanism includes support means that are disposed below, or angularly offset and below, a portion of the chamber.

The present invention provides a grinding apparatus which, structurally and economically simple means, improves the sealing of the chamber and reduces the development of noise, without adversely affecting or obstructing the movement of components, while the apparatus as a whole requires less space. The surfaces and lines that have to be sealed-off are reduced to a minimum, whereupon a good sealing effect is provided. The size of a chamber means that only a small resonance residence compartment results, which permits only a slight development of noise. The sealing effect of the chamber of the inventive grinding apparatus is such that the interior of the chamber can be partially or completely filled with grinding liquid, so that the grinding process can be effected partially or completely in a liquid medium, which further reduces the development of noise to a minimum level.

The chamber is disposed on the apparatus frame as an enclosed-type member, and is not in contact with moving or rotating parts of the apparatus. Thus, in particular the movement of the grinding wheel during finishing or grinding of the lens periphery, is not transmitted to the chamber. Exchange or replacement of the grinding wheel can be effected quite simply. It is merely necessary to pull the overhung shaft of the grinding wheel axially out of the receiving bore provided therfore in a side wall of the chamber, and to then remove the grinding wheel from the chamber through the opened observation window thereof. It is not necessary to have an additional opening that would then have to be sealed-off.

Further specific features of the present invention will be described in detail subsequently.

DESCRIPTION OF PREFERRED EMBODIMENTS

Referring now to the drawing in detail, in the embodiment illustrated in FIG. 1, four small support brackets 4, 5 are disposed on the plate-like, square or rectangular apparatus frame 1, two in the vicinity of each of the edges 2, 3. The bores of the brackets 4, 5 extend parallel to the edges 2, 3 and each bore fixedly holds an end of a rigid shaft, spindle, or rod 6. A small elongated block 7 is disposed on this rod 6 in such a way that it is slideable in the direction of the double arrow S. The block 7 preferably has a square cross-sectional shape, and also has a longitudinal bore 8 through which the rod 6 passes.

On that side facing the center M of the frame 1, the longitudinally slidable block 7 is provided with two parallel guide and support rods 9, 10 which, at a distance from the top 1a of the frame 1, are held on the two small blocks 7. In the vicinity of the blocks 7, the two parallel guide and support rods 9, 10 pass through the bores 11 of two upwardly directed extensions or ribs 12. On the bottoms of the extensions or ribs 12 is a horizontal support carriage 13 that extends essentially at right angles to the center line M of the frame 1. The parts 4–13 form a cross-carriage mechanism such that the support carriage 13 can be slid not only in the direction of the double arrow S, but also in the direction of the double arrow N.

Mounted on that extension or rib 12 that is closer to the viewer and is visible in FIG. 1, or directly on the support carriage 13, is a slightly bent arm 14 that extends in a plane which is perpendicular to the top **1*a* of the frame and is parallel to the center line M. A motor 15 is secured to the upper, free end of this arm 14. The shaft 16 of the motor extends through a bore of the arm 14, and a drive belt 17** is looped around the free end of this shaft.

Disposed on the arm 14, adjacent to the extension or rib 12, is a non-illustrated support that is horizontal and parallel to the guide and support rods 9, 10, and that supports a shaft 18. The drive belt 17 is also looped around the free end of the shaft 18, which is adjacent to the arm 14. The motor 15, which, as previously mentioned, is connected to the arm 14, extends parallel to the edge 19 of the frame 1 over the central portion thereof. The motor 15 drives the overhung shaft 18, which is rotatably supported in the nonillustrated support of the arm 14. Fixedly mounted on this shaft 18, which is disposed parallel to the motor shaft 16, over the central portion of the frame 1, is the grinding wheel 20, which is driven by the motor 15 and, with the aid of the cross-carriage mechanism comprised of the parts 4–13, is movable in the directions of the arrows N and S.

Disposed in the vicinity of the edge 21 of the frame 1 are two perpendicular support legs 22, 23 that extend parallel to the edges 2 and 3. These legs 22, 23 support a chamber 24 which, in a vertical plane through the center line M, has an approximately oval cross-sectional shape, and which has two side walls 25, 26. The upper wall of the chamber 24 has a hinged window 27 in that region that faces, at A, the user of the apparatus. With the aid of the hinge joints 28, which can also be disposed on the outer side of the chamber 24, the window 27 can be raised. For this purpose, a handle 29 can be provided. Supports 30, 31 extend through the side walls 25, 26 of the chamber 24 on that portion thereof which faces the edge 21 of the frame 1. These supports 30, 31 accommodate the two partial shafts 32, 33 that forms the lens shaft. Furthermore, the supports 30, 31 are sealed-off relative to the two side walls 25, 26 of the chamber 24 in a leak-proof manner. The lens B can be held between the two partial shafts 32, 33 in a known manner; in this connection, the partial shaft 33 can be shifted in a longitudinal direction. The template or pattern 34 is secured to the partial shaft 32, which extends beyond the support 31.

The grinding wheel shaft 18 extends through that side wall of the chamber 24 which is adjacent to the arm 14. To move the shaft 18 in conformity with the arrows N and S of the cross-carriage mechanism, which comprises the parts 4–13, an elongated slot 35 is provided in the side wall 26. While taking into consideration the sealing means 36 at the slot 35, as will be described subsequently, the length of the slot 35 takes into account the movement of the shaft 18 in conformity with the arrow S, and the height of the slot 35 takes into account the movement of the shaft 18 in conformity to the arrow N. The sealing means 36 is preferably a flexible bellows such as is known in other technical areas for sealing-off parts, which are movable in two coordinates, relative to the edges of an opening.

In the embodiment illustrated in FIG. 2, a frame 1 is again provided on which are disposed four support members 51, pairs of which accommodate the free ends of the shaft, spindle, or rod 52 on which the small block 53 is longitudinally movable. The blocks 53 support the parallel, horizontal guide and support rods 54, 55 on which the support carriage 56 is guided. By means of an intermediate piece 57, an arm 58 is horizontally held on the carriage 56. On one end of the arm 58, the motor 59 is mounted, while the other end of the arm 14 carries the non-illustrated support of the shaft 60 of the grinding wheel 66. The motor shaft and the shaft 60 of the grinding wheel 66 are connected with one another by a belt 61 or the like. In this embodiment also, a chamber 63, which can have the same shape as does the chamber 24 of FIG. 1, is supported on legs 62 of the frame 1. The supports of the lens-holder shaft 64 are guided through the side walls of the chamber 63. That side wall of the chamber 63 that faces the viewer of FIG. 2 is again provided with an elongated slot 65 that corresponds to the slot 35 of FIG. 1, and that is sealed-off with the aid of a flexible bellows. The embodiment of FIG. 2 has the advantage of taking up less space, and of a weight balance at the arm 58 due to the grinding wheel 66 and its shaft 60 on the one hand, and the motor 59 on the other hand.

In the embodiment illustrated in FIG. 3, the chamber 70, which can have the same shape as the chambers of FIGS. 1 and 2, is placed at an angle $\alpha$ of 30° to 60° degrees to a horizontal central plane. A support bracket 71 is provided on an elevation **2*a* of the frame 1. The support bracket 71 supports a horizontal shaft, spindle, or rod 72, around which extends a bearing 73, the outer bearing ring of which can be shifted on the rod 72 in the direction of the double arrow K, with this outer bearing ring also being rotatable about the rod 72 in the direction of the double arrow P. This outer bearing ring carries a sleeve 74 on which are mounted an arm 75 and an arm 76. These two are 75, 76 arm preferably disposed at angle of from 30° to 60° relative to one another. The motor 75*a* is mounted on the arm 75, while the free end of the arm 76 carries the support for the shaft 77 of the grinding wheel 78. That side wall of the chamber 70 which faces the viewer of FIG. 3 is provided with a rounded elongated slot 79, the curvature of which corresponds to a section of a circular arc about the rod 72. The edge of the opening 79 is again sealed off via a flexible bellows 80 relative to the shaft 77, which can execute a movement in conformity with the arrows K and P. The supports for the two partial shafts of the lens shaft 81 again extend in a sealed manner through the two side walls of the chamber 70**.

The box or chamber 24, 63, 70 of FIGS. 1 to 3 forms an enclosed-type container that at appropriate locations is provided with a liquid inlet and a liquid outlet. The inlet and outlet are embodied in such a way that the chamber can be filled entirely or partially with liquid. This partial or complete filling of the chamber with liquid largely prevents a resonance of the chamber, i.e. the liquid to a large extent absorbs or dampens the vibrations to which the chamber is exposed during the grinding process.

As can be seen from FIGS. 1 to 3, the chamber 24, 63, 70 is arranged in such a way that space is saved. As an enclosed-type container, the chamber 24 of FIG. 1 completely overlaps the cross-carriage mechanism composed of the parts 4–13, and the chamber 63 of FIG. 2 at least partially overlaps the cross-carriage arrangement composed of the parts 51–56. In FIG. 3, the space required for the chamber 70 corresponds to only a portion of the length thereof. Those parts that support the overhung shaft 18, 60, 77 of the grinding wheel are disposed completely beyond the chamber and are disposed in a space-saving manner independent of the chamber.

The width of the chamber 24, 63, 70 corresponds to the width of the grinding wheel plus the longitudinal movement of the latter relative to the lens. The bellows of the opening through which the grinding wheel shaft extends is appropriately shaped and is made of a suitable material.

The opening that can be closed by the hinged window 27 is such that while taking into account the two partial lens shafts, the grinding wheel 20 can be withdrawn from the chamber 24, through this opening, after the overhung shaft 18 has been pulled out of the chamber far enough that the free end of the shaft releases the grinding wheel. For this purpose, the width, as measured perpendicular to the shaft 18, of the opening that can be closed by the window 27 is greater than the diameter of the grinding wheel. In this way there is provided a container, most of the parts of which are fixedly and sealingly interconnected.

The present invention is, of course, in no way restricted to the specific disclosure of the specification and drawing, but also encompasses any modifications within the scope of the appended claims.

What we claim is:

1. An apparatus for grinding the edges of lenses, comprising:

a frame;

a lens shaft journaled on said frame;

a motor driven grinding wheel that can be moved against a lens as well as being shiftable parallel to said lens shaft;

a chamber means that is mounted on said frame and accommodates said lens and said grinding wheel; said chamber means has an observation window and walls thereof, including oppositely disposed side walls that extend essentially perpendicular to said lens shaft, with said walls enclosing, and being spaced slightly from, said grinding wheel and said lens; said chamber means has a width that is approximately equal to the thickness of said grinding wheel plus the axial displacement stroke of the latter;

a grinding wheel shaft that extends through one of said chamber side walls and has two ends, one of which is disposed in said chamber means and carries said grinding wheel, and the other of which extends beyond said one side wall; and a mechanism that supports and drivingly interconnects said grinding wheel shaft and a motor located in common thereby for movement in different directions, with said mechanism being displaceably mounted on said frame so that said mechanism and said grinding wheel shaft, and hence said grinding wheel, can be moved toward and away from said lens, and parallel to said lens shaft, in two directions that are essentially perpendicular to one another.

2. An apparatus according to claim 1, in which said frame is a plate-like frame, and said lens shaft and said grinding wheel shaft are disposed in a plane that extends parallel to said plate-like frame.

3. An apparatus according to claim 1, in which said frame is a plate-like frame, and said lens shaft and said grinding wheel shaft are disposed in a plane that extends at an angle to said plate-like frame.

4. An apparatus according to claim 1, in which said mechanism includes support means for said grinding wheel shaft and said motor, with said support means being disposed at least partially below a portion of said chamber means.

5. An apparatus according to claim 1, in which said mechanism includes support means for said grinding wheel shaft and said motor, with said support means being disposed at least partially below, and off to the side of, a portion of said chamber.

6. An apparatus according to claim 1, in which a portion only of said chamber means is securely yet detachably connected to said frame.

7. An apparatus according to claim 6, in which said chamber means has an oval longitudinal cross-sectional shape wherein said grinding wheel shaft and said lens shaft are arranged on both sides of a transverse median plane of said chamber means.

8. An apparatus according to claim 6, in which said chamber portion is indirectly connected to said frame.

9. An apparatus according to claim 1, in which said mechanism includes a cross-carriage and, disposed on the latter, an arm on which are disposed both said grinding wheel shaft and said motor.

10. An apparatus according to claim 1, in which said mechanism includes a rod that is disposed parallel to said lens shaft, and arm means that is displaceably and rotatably mounted on said rod, with both said grinding wheel shaft and said motor being disposed on said arm means.

11. An apparatus according to claim 1, in which said observation window of said chamber means has a dimension, measured at right angles to said grinding wheel shaft, that is greater than the diameter of said grinding wheel.

* * * * *